United States Patent [19]

Bischoff, Jr.

[11] 4,124,238

[45] Nov. 7, 1978

[54] LATCH BOLT MECHANISM

[76] Inventor: Robert F. Bischoff, Jr., 30 Fairmont Ave., Morristown, N.J. 08094

[21] Appl. No.: 628,137

[22] Filed: Nov. 3, 1975

[51] Int. Cl.[2] ..... E05C 1/16

[52] U.S. Cl. ..... 292/173

[58] Field of Search ..... 292/169, 169.13, 175, 292/164, 306, 172, 173, 174, 164, 167

[56] References Cited

U.S. PATENT DOCUMENTS

| | | | |
|---|---|---|---|
| 1,220,939 | 3/1917 | Boch | 70/143 |
| 2,958,553 | 11/1960 | Phillips | 292/169 |
| 3,339,963 | 9/1967 | Chambers | 292/306 X |
| 3,353,858 | 11/1967 | Neary et al. | 292/164 |
| 3,891,255 | 6/1975 | Millett | 292/169 B |
| 3,912,309 | 10/1975 | Fischer et al. | 292/167 |
| 3,933,380 | 1/1976 | Wellekens | 292/175 |

*Primary Examiner*—Richard E. Moore

[57] ABSTRACT

This invention relates to a door lock, and particularly to a lock whose latch bolt extends beyond what is considered normal extension for a door lock. This invented lock not only fastens the door closed, but it also has a second function; namely, to act as a dead lock.

6 Claims, 15 Drawing Figures

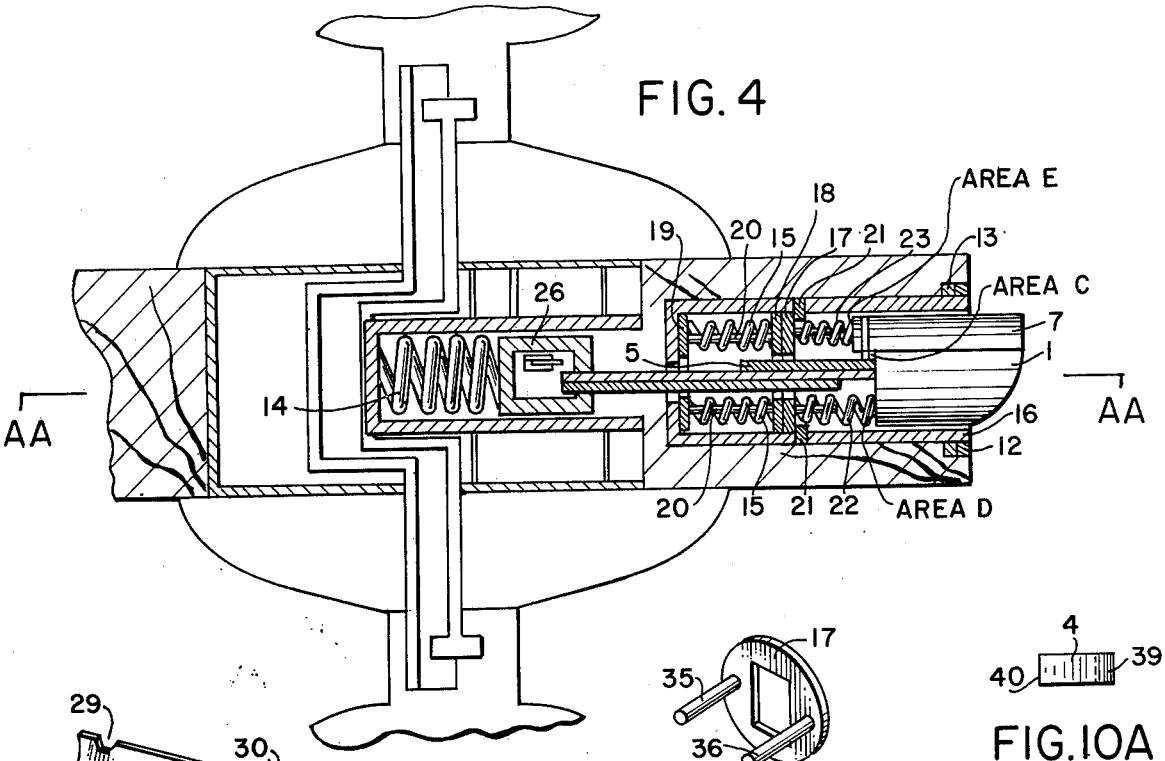
FIG. 4
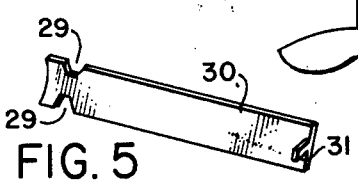
FIG. 5
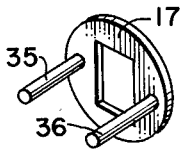
FIG. 8
FIG. 10A
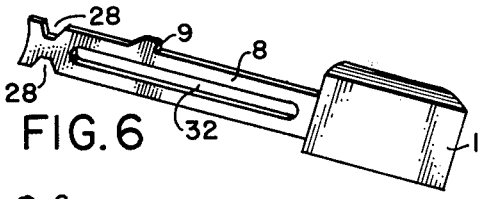
FIG. 6
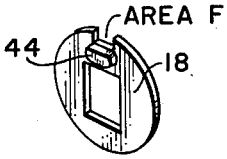
FIG. 9
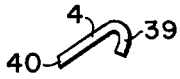
FIG. 10B
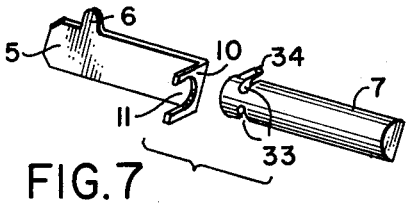
FIG. 7
FIG. 15
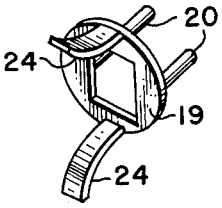
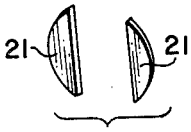
FIG. 14
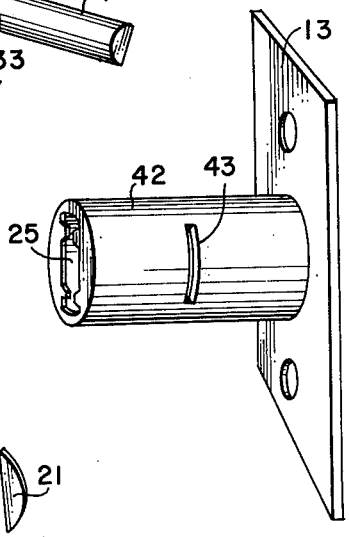
FIG. 13
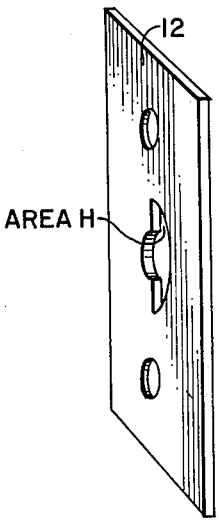
FIG. 12
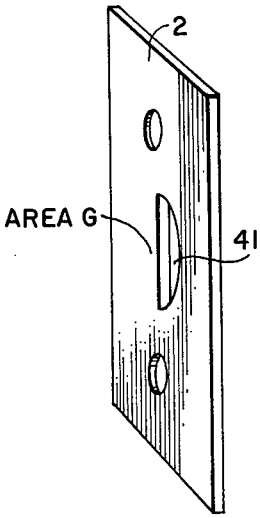
FIG. 11

LATCH BOLT MECHANISM

The object of this invention is to generally improve the operation of a door lock by providing a latch bolt mechanism which is able to act as both a latch and also as a dead lock.

Previous latches, which said latches can be adapted to this invention, were constructed so that they were a door lock with a latch bolt which was dogged, said dogged latch bolt preventing recession of the latch bolt by jimmying. My invention is an improvement in this construction in that when my door is in a closed position, the latch bolt extends far into the striker plate, making the lock a dead lock. This said extension of the latch bolt is obtained by using a dogging unit, which said dogging unit holds the latch bolt at half of its extension when said lock is in its opened position. Once the lock is in a closed position, said lock establishes a closed position with the latch bolt mechanism extending twice the distance of its opened position.

Another innovation of this invention is that the dog does not prevent the latch bolt from being recessed when said bolt is jimmied. When functioning, the dog rides upon the inclined shoulder of the auxiliary latch bolt bar, and said dog then releases the latch bolt into a fully extended position into the striker plate; the auxiliary latch bolt does not ride into the striker plate with the latch bolt. This dog, therefore, has the sole purpose of holding the latch bolt in a half-extended position.

Another type of dogging of the latch bolt, which said dogging prevents the latch bolt from being recessed when in a closed position, is illustrated in my co-pending application entitled "A Door Lock Turning Mechanism."

This innovative latch bolt mechanism is an improvement in a latch bolt mechanism of a door lock, and though this invented mechanism can be adapted to multiple turning mechanisms, as well as to other types of door locks, this invention is used in my co-pending application as stated above, exclusively.

Referring to the Drawings:

FIG. 4 is a cross-sectional top view of the lock mechanism with the latch bolt in a half-extended position, taken through B—B of FIG. 2;

FIG. 5 is a perspective view of the guide;

FIG. 6 is a perspective view of the latch bolt, with the latch bolt bar attached thereto;

FIG. 7 is a perspective view of the auxiliary bolt with the auxiliary latch bolt bar;

FIG. 8 is a perspective view of the front plate of the dogging unit, which said plate helps hold the dog in position;

FIG. 9 is a perspective view of the back plate of the dogging unit, which said plate holds the dog in position;

FIG. 10A is a top view of the dog; FIG. 10B is a side view of the dog;

FIG. 11 is a perspective view of the striker plate;

FIG. 12 is a perspective view of the outer fastening plate of the latch bolt mechanism;

FIG. 13 is a perspective view of the latch bolt cylinder housing with a primary plate attached thereto;

FIG. 14 is a perspective view of the metal components, which said components prevent the dog's holding plates from moving forward in the latch bolt cylinder;

FIG. 15 is a perspective view of a reinforcing plate, which said plate is inserted in the bottom or lower end of the latch bolt cylinder housing;

Figure 1:
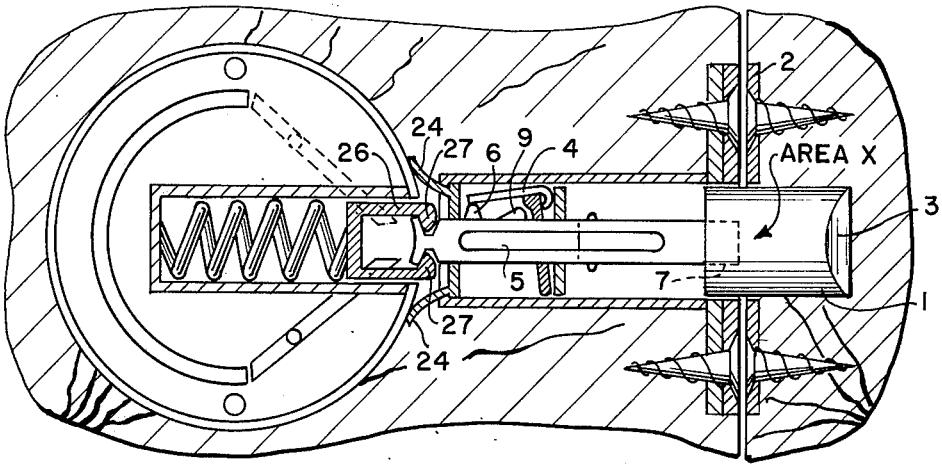
FIG. 1 is a cross-sectional side view of the lock mechanism with the latch bolt in a fully extended position.
Figure 2:
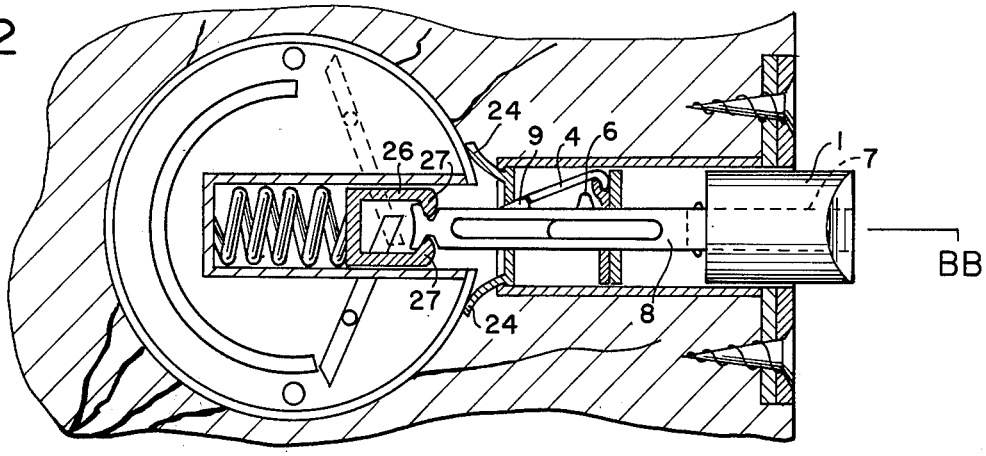
FIG. 2 is a cross-sectional side view of the lock mechanism with the latch bolt in a half-extended position, taken through A—A of FIG. 4.
Figure 3:
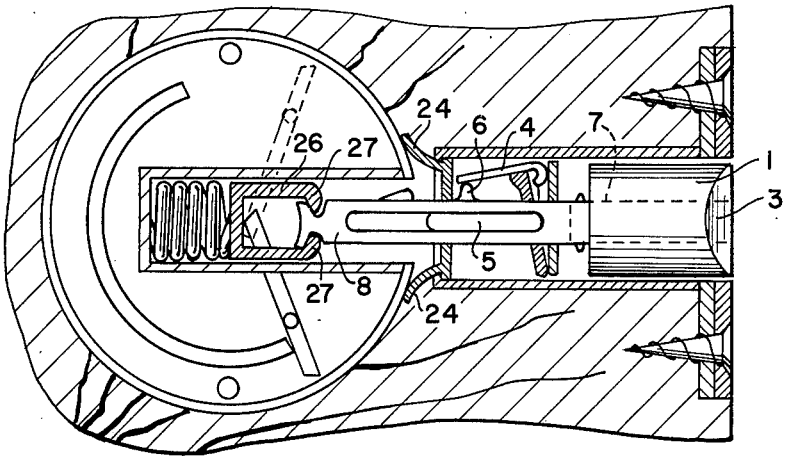
FIG. 3 is a cross-sectional side view of the lock mechanism with the latch bolt in a fully recessed position.

FIGS. 1 through 3 indicate the principal positions that the latch bolt mechanism assumes during proper functioning of the lock. Though these views are cross-sectional and one of the levers would not normally be seen in these views, this said lever has been designated in FIGS. 1 through 3 by a broken line for clarity regarding the explanation of its functioning.

FIG. 1 indicates the latch bolt in a fully extended position. In this fully extended position of the latch bolt 1, this invented lock has the ability to act as a door lock, and also as a dead lock. For when the latch bolt 1 is thus fully extended into the striker plate 2, the position of the latch bolt is such that when the said bolt is jimmied with a thin tool, the tool will only come into contact with Area "X" of the latch bolt. The said tool will not come into contact with the curved surface 3 of the end of the latch bolt, which said contact is the object of a jimmying tool, that is, to contact the curved surface 3 of the said latch bolt, and thus push it back from its position of contact with the striker plate 2.

In FIG. 1, the dog 4 is elevated by the auxiliary latch bolt bar's 5 inclined shoulder 6. This elevation of the dog 4 keeps the auxiliary latch bolt 7 in position as shown in FIG. 1, when the door or lock is in a closed position, and in this position, the striker plate 2 is used as a stopping plate for auxiliary latch bolt 7, since there is no area through the striker plate for the said auxiliary bolt, thereby, only the latch bolt 1 projects through the striker plate 2. As a result, the auxiliary bolt's inclined shoulder 6 retains the position whereby it elevates the dog, thus permitting the latch bolt to move forward into its fully extended or closed position as shown in FIG. 1.

In FIG. 2, taken through A—A of FIG. 4, the latch bolt 1 is in a half-extended position. This position results when the door or lock is in a position other than the closed position so that the auxiliary latch bolt 7 is not held back by the striker plate. In this position, the auxiliary latch bolt 7 moves forward, releasing its inclined shoulder 6 from the dog 4, whereupon the said dog is then forced to descend down into a position such that it will dog the inclined shoulder 9 of the latch bolt bar 8, thus preventing the latch bolt from moving forward. The inclined front surface of the inclined shoulder 9 of the latch bolt bar 8 is so positioned that when the dog is pressured down upon being released from the inclined shoulder of the auxiliary latch bolt, said dog contacts the inclined shoulder 9 of the latch bolt bar, said contact thereby causing the latch bolt to remain in a dogged position.

FIG. 3 shows the latch bolt 1 in a fully recessed position. This position results when the turning mechanism of the lock is fully turned by use of the doorknob, or when the latch bolt is sliding over the striker plate, or when said recession is caused manually.

The auxiliary latch bolt bar 5 has a side which forms a right angle with the said bar's bottom, and said side, therefore, butts against one part of the back wall (Area C, FIG. 4) of the latch bolt, thereupon forcing movement of the auxiliary latch bolt 7 to correspond to movement of the latch bolt 1, when said latch bolt is in the positions depicted in FIGS. 2 and 3; however, the movement of the auxiliary latch bolt and of the latch bolt do not correspond when the latch bolt is in the position depicted in FIG. 1, since the striker plate holds the auxiliary latch bolt from moving concurrently with the latch bolt.

In FIG. 1, the auxiliary latch bolt 7 is depressed by the striker plate 2, causing the latch bolt to be fully extended. Such a similar position could occur when the door is opened as shown in FIG. 2, if the auxiliary latch bolt is depressed accidentally. In this situation, once the auxiliary latch bolt is released, however, both the latch bolt and the auxiliary latch bolt would be fully extended. This will be not problem unless the door lock needs to be positioned for slamming of the door. However, when this happened, that is, both the latch bolt and the auxiliary latch bolt are fully extended accidentally, all that is required for the door lock to be repositioned is either for the doorknob to be turned, or for the latch bolt to be manually pushed in so that the latch bolt is in a half-extended position as illustrated in FIG. 2.

In this said accidental situation there would also be danger that the auxiliary latch bolt would tend to project through the front and back mounting plates of the latch bolt mechanism. (FIGS. 4, 12 and 13). To prevent this, FIG. 7 shows that the upper portion of the auxiliary latch bolt bar side 10 has cut into it a "U-shape" 11 in which U-shape the auxiliary latch bolt 7 sits. The upper ends of this "U" are a trifle longer than the opening in the mounting plates through which project the auxiliary latch bolt and the latch bolt. Because of this extra length, it is impossible for the auxiliary latch bolt to project through the said mounting plates (FIGS. 4–12, 13) in this situation given above.

In FIG. 1, the dog 4 sits on the upper back edge of the inclined shoulder of the auxiliary latch bolt 6 when the turning mechnism is released so that the latch bolt mechanism moves forward and the latch bolt is in its fully extended position, or said dog so sits when the latch bolt is fully recessed as depicted in FIG. 3. It is, therefore, apparent that from this position shown in FIG. 3, the auxiliary latch bolt bar's inclined shoulder would only have to move a slight distance to be away from the dog 4 well in advance of the forward movement of the latch bolt's inclined shoulder 9, so that said dog 4 thereby engages this said shoulder 9.

FIG. 4 shows a cross-sectional top view of the lock mechanism taken through B—B of FIG. 2. The main spring 14 in the turning mechanism is one of the principal forces which keeps the latch bolt mechanism in its forward position, that is, forward toward the mounting plates 12, 13. The rear springs 15 of the latch bolt mechanism housing 16 keep and equalize pressure between the plates of the dogging mechanism 17, 18 and the rear plate of the latch bolt mechanism housing 16.

The rear plate 19 of the said housing has two rods 20 mounted on the front of it. These said rods 20 have a twofold purpose; first, they help center the springs 15, and secondly, they act as separators between the said rear plate 19 and the two plates 17, 18 of the dogging mechanism, but said plates still allow for movement of the dogging mechamism. Without this separation, the dogging assembly would slide toward the rear end of the latch bolt mechanism housing 16.

The bits of metal 21, FIG. 14, which are fused onto the outside of the latch bolt mechanism housing 16 and project into the inside of said housing, are used as butts for the front plate 17 of the dogging mechanism. These bits of metal prevent the said dogging mechanism from moving to a forward position in the said housing.

The latch bolt 1 has a spring 22, which spring gives the latch bolt added force so that is maintains its forward position.

The auxiliary latch bolt spring 23 keeps the auxiliary latch bolt 7 in a forward position. The strength of this spring 23 is such that it much keep the auxiliary latch bolt 7 ahead of the latch bolt 1 in forward movement so that the dog engages the shoulder of the latch bolt bar 5 when both bolts are released from a fully recessed position to the position where the latch bolt is half-extended.

The rear plate of the latch bolt mechamism housing has two arching arms (FIGS. 1–3, 24), which said arms project from the said plate and through the rear opening (FIGS. 13, 25) of the said housing. These arms are for the contacting of the latch bolt mechanism housing with the turning mechanism housing.

In FIGS. 1–4, the retractor 26 in the turning mechanism engages the latch bolt mechanism so that said retractor and said mechanism move in conjunction. Such engagement occurs between the gripping end of the retractor (FIGS. 1–3, 27) and the grooved ends of the latch bolt bar (FIGS. 1–3, 8) and the guide grooved end (FIGS. 5, 29).

FIGS. 5 through 14 illustrate views of components which comprise the latch bolt mechanism. Omitted in these views are the springs.

FIG. 5 is the guide 30, which said guide is positioned along the opposite side of the latch bolt bar from the auxiliary latch bolt. This said guide 30 is used to help guide the latch bolt mechanism when it is in movement. On the front end of the guide is a tip 31, which said tip fits into the opening shown in FIGS. 6, 32 of the latch bolt bar, so that said fitting helps align the guide. The other end of the guide is grooved, and said grooved end 29 joins with the latch bolt bar to the retractor (FIGS. 1–4, 26) of the turning mechanism.

FIG. 6 shows the latch bolt 1 with the latch bolt bar 8 attached thereto. The construction of the unit can be done by uniting the bolt and the bar when they are originally formed, or it may be formed by uniting two separate parts with a pin. The area (Area "D"-FIG. 4) within the latch bolt of the unit where the spring (FIGS. 4, 22) makes contact, has a recession and a rod within the recession to help stabilize the position of the said spring.

Similiary to the guide mentioned previously, the opposite end 28 of the latch bolt bar is shaped so that the retractor of the turning mechanism is attached thereto. The horizontal opening 32 through the center of the latch bolt bar is for the alignment of the tip 31 of the guide 30, as shown in FIG. 5. The inclined shoulder of the latch bolt bar (FIGS. 6, 9) is that shoulder upon which the dog positions itself when the latch bolt is in its half-extended position.

FIG. 7 depicts the auxiliary latch bolt 7 with its bar 5. The auxiliary latch bolt 7 is so shaped that the cross-sectional view simulates a half circle, with the base of this half circle being that part which rides upon the latch bolt. FIG. 7 shows that the auxiliary latch bolt 7 has on its left side a groove 33 into which the latch bolt bar fits so that said bar and said bolt are united. Also on the left side rear of the auxiliary latch bolt 7 there is an elbow with a slight projection 34 so that when the auxiliary latch bolt rides upon the latch bolt, this said projection 34 forms a butt which prevents the auxiliary latch bolt 7 from springing too far forward. The auxiliary latch bolt bar 5 is shaped like a "U" on its front side 11. This U-shape is necessary so that the auxiliary latch bolt 7 can fit into the said U-shape 11. Toward the back of the auxiliary latch bolt bar is the said bar's inclined shoulder 6, which shoulder is used to elevate the dog, when the auxiliary latch bolt bar is so positioned to do so. This said inclined shoulder is of greater height than the inclined shoulder of the latch bolt bar. The back end of the auxiliary latch bolt bar is not made for engagement with the retractor of the turning mechanism, because the movement of the auxiliary latch bolt bar is caused by the said bar's relation to the latch bolt mechanism and to the striker plate rather than by its relationship to the retractor.

The area (Area E-FIG. 4) within the auxiliary latch bolt where the spring (FIGS. 4, 23) makes contact, has a recession and a rod within the recession to help stabilize the position of the said spring.

FIG. 8 shows the front plate of the dogging mechanism 17 with the rods (35, 36) which help stabilize the auxiliary latch bolt spring and the latch bolt spring, when said springs (FIGS. 4–22, 23) are positioned.

FIG. 9 is the back plate of the dogging mechanism 18 depicting Area "F", which is a cut-out area that permits the dog to position properly for its correct functioning. There are holes through both plates of the dogging mechanism (FIGS. 8, 17) (FIGS. 9, 18), through which holes the bars and the guide of the latch bolt mechanism move.

Below Area "F", which said area holds the dog in position, there is a bulging section 44, which said section allows room for the dog (FIG. 10) to fit between the two plates (FIGS. 8, 17; 9, 18) of the dogging mechanism.

FIG. 10 depicts the shape of the dog 4, which shape permits the right side 39 of the dog, when placed between its two plates, to receive pressure from the latch bolt mechanism such that the direction of the left side 40 of the said dog is always inclined to keep downward as shown in the positions depicted in FIGS. 1 through 3, which said inclination causes the dog to be in the correct position for its desired functioning.

FIG. 11 is the striker plate 2, depicting the opening 41 through which the latch bolt enters, and the Area "G" against which the auxiliary latch bolt butts.

FIG. 12 depicts the front attaching plate 12 of the latch bolt mechanism housing, with Area "H" showing that area through which the latch bolt and the auxiliary latch bolt pass.

FIG. 13 shows the latch bolt cylinder 42 with the primary plate 13 attached thereto. The opening 43 within the said cylinder permits the attachment of the bits of metal (FIGS. 4, 21; FIG. 14), which said bits of metal act as butts when attached to the interior of the said cylinder. These bits of metal are for the dogging mechanism so that said mechanism is held in its correct position. The opening 25 at the rear end of the cylinder housing 42 permits the rear reinforcing plate (FIG. 15) to be inserted therein, and also permits a back and forth movement through its center of the latch bolt bar, the auxiliary latch bolt bar, and the guide.

FIG. 14 depicts the bits of metal 21, which said bits of metal act as butts for the dogging mechanism when said bits of metal are placed so that they project to the interior of the latch bolt cylinder.

FIG. 15 is the rear reinforcing plate 19 of the latch bolt housing, which said plate is inserted inside the back end of the latch bolt cylinder. The function of this said plate is to guide the movement of the auxiliary latch bolt and the latch bolt bars and the guide. The two arching arms 24 which project out of the back of the said reinforcing plate rest on the housing of the turning mechanism. The rods 20 which project from the said reinforcing plate toward the front of the latch bolt cylinder are used to both properly align the springs which encircle said rods (FIGS. 4, 15), and as spacers between the rear reinforcing plate and the dogging mechanism.

Although but a single embodiment of my invention has been illustrated and described, it is apparent to those skilled in the art, that various changes and modifications may be made therein without departing from the spirit of the invention or from the scope of the appended claims.

A latch bolt mechanism of a character described, said latch bolt mechanism embodying a latch consisting and functioning as follows:

I claim:

1. In a latch bolt mechanism of the general type, comprising (a) a latch bolt movable into retracted, extended and dead-bolt positions, (b) an auxiliary bolt cooperatively associated with said latch bolt and movable into retracted and extended positions, (c) striker plate means engageable with said latch and auxiliary bolts, (d) said striker plate means having means for displacing said latch and auxiliary bolts from extended to retracted positions and having recess means for receiving said latch bolt and providing for displacement of said latch bolt from its retracted position to its dead-bolt position, and (e) dogging means associated with said latch and auxiliary bolts whereby, when said auxiliary bolt is extended, said latch bolt is blocked from extending beyond its extended position and, when said auxiliary bolt is held in its retracted position, said latch bolt is freed to extend to its dead-bolt position, (f) said dogging means including a lever-like dogging element pivotally mounted in said mechanism and movable between dogging and releasing positions with respect to said latch bolt, (g) means for yieldably urging said dogging element into its latch bolt dogging position, (h) a locking shoulder carried by said latch bolt and engageable with said dogging element when the latter is in dogging position, (i) a camming shoulder carried by said auxiliary bolt and operable upon movement of said latch bolt from retracted to extended positions while said auxiliary bolt is retained in retracted position to displace and dogging element to its release position and thereby permit said latch bolt to extend further to said dead-bolt position, the improvement characterized by (j) said latch and auxiliary bolts having rearwardly extending slide portions of smaller combined cross section than said latch and auxiliary bolts, (k) said slide portions carrying said locking and camming shoulders, (l) a tubular housing slideably containing and guiding said latch and auxiliary bolts and at least partly enclosing said slide portions thereof, (m) said dogging element being pivotally mounted within said tubular housing and having a laterally displaceable leg portion extending rearwardly for motion limiting engagement with said locking shoulder, (n) said leg portion being laterally displaceable by rearward movement of said camming shoulder.

2. A latch bolt mechanism according to claim 1, further characterized by (a) said dogging element comprising a J-shaped lever, (b) abutment surface means provided within said tubular housing and forming a pivot surface for said J-shaped lever, (c) a movable plate received within said tubular housing and yieldably urged toward said abutment surface, (d) the shorter leg of said J-shaped lever being positioned between said plate and said abutment surface and operative, in conjunction with said yieldably urged plate, to yieldably pivot said lever toward its latch bolt locking position.

3. A latch bolt mechanism according to claim 2, further characterized by (a) said abutment surface being formed by a plate transversely disposed within said housing and slideably receiving the slide portions of said latch and auxiliary bolts, (b) compressible coil spring means received within said tubular housing and urging and first mentioned plate toward said abutment surface forming plate.

4. A latch bolt mechanism according to claim 1, further characterized by (a) said tubular housing being of generally cylindrical form and of substantially uniform cross section throughout the length thereof containing said latch and auxiliary bolts and said dogging means.

5. A latch bolt mechanism according to claim 4, further characterized by (a) said dogging means including a pair of transversely disposed disc-like plates received in said tubular housing behind said latch and auxiliary bolts, (b) the slide portions of said latch and auxiliary bolts being slideably received within openings in said disc-like plates, (c) said dogging element comprising a generally J-shaped lever having an elongated, rearwardly extending locking leg and a short, transversely extending actuating leg, (d) said actuating leg being positioned between said disc-like plates, (e) means yieldably urging said disc-like plates toward each other to urge said actuating leg into a predetermined position, with said locking leg in position to engage said locking shoulder, (f) said lever being yieldably displaceable by engagement of said locking leg by said camming shoulder during rearward movement of said auxiliary bolt.

6. A latch bolt mechanism according to claim 5, further characterized by (a) the portion of said dogging lever, between said locking and actuating legs, forming a pivot surface, (b) said pivot surface engaging and being supported by one of said disc-like plates.

* * * * *